US010433691B2

(12) United States Patent
Pougher et al.

(10) Patent No.: US 10,433,691 B2
(45) Date of Patent: Oct. 8, 2019

(54) SEPARATOR ASSEMBLY FOR A SUCTION CLEANING APPARATUS

(71) Applicant: TECHTRONIC FLOOR CARE TECHNOLOGY LIMITED, Tortola (VG)

(72) Inventors: Simon Matthew Pougher, West Midlands (GB); Mark Stephen Barnsley, West Midlands (GB); Jonathan Haydn Boxhill, West Midlands (GB)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 15/128,896

(22) PCT Filed: Mar. 26, 2014

(86) PCT No.: PCT/GB2014/050952
§ 371 (c)(1),
(2) Date: Sep. 23, 2016

(87) PCT Pub. No.: WO2015/145095
PCT Pub. Date: Oct. 1, 2015

(65) Prior Publication Data

US 2017/0112342 A1 Apr. 27, 2017

(51) Int. Cl.
*A47L 9/16* (2006.01)
*A47L 9/24* (2006.01)
*B04C 5/187* (2006.01)

(52) U.S. Cl.
CPC ..... *A47L 9/1666* (2013.01); *A47L 9/165* (2013.01); *A47L 9/1608* (2013.01);
(Continued)

(58) Field of Classification Search
CPC .... A47L 9/1666; A47L 9/0608; A47L 9/1683; A47L 9/24
See application file for complete search history.

(56) References Cited

U.S. PATENT DOCUMENTS 6,269,518 B1 8/2001 Yung
7,717,973 B2 5/2010 Oh et al.
(Continued)

FOREIGN PATENT DOCUMENTS

EP 2033562 A2 3/2009
EP 2702914 A2 3/2014
(Continued)

OTHER PUBLICATIONS

International Search Report, PCT/GB2014/050359, dated Dec. 10, 2014 (4 pages).
(Continued)

*Primary Examiner* — Dung Van Nguyen
(74) *Attorney, Agent, or Firm* — Michael Best & Friedrich LLP

(57) ABSTRACT

A cyclonic separator assembly having a first end, a second end, and an inlet for receiving a flow of dirty air. A separation chamber receives dirty air from the inlet and includes an air flow outlet formed within the separation chamber configured such that air is drawn through the outlet in a direction generally towards the first end of the separator assembly. The chamber further includes a dirt outlet defining an opening in a wall of the separation chamber. The assembly further includes a passage defining an air flow path from the air flow outlet towards a separator outlet in a direction generally towards the second end of the separator assembly such that, in use, the separator outlet is adapted to communicate with the suction inlet of the cleaner body so as to draw dirty air into the separator assembly.

14 Claims, 7 Drawing Sheets

(52) U.S. Cl.
CPC ..... *A47L 9/1683* (2013.01); *A47L 9/24* (2013.01); *B04C 5/187* (2013.01)

(56) References Cited

U.S. PATENT DOCUMENTS

| | | | | |
|---|---|---|---|---|
| 8,590,102 | B2 * | 11/2013 | Conrad | A47L 5/24 15/353 |
| 8,997,309 | B2 * | 4/2015 | Conrad | A47L 9/1683 15/353 |
| 9,125,534 | B2 * | 9/2015 | Kim | A47L 9/122 |
| 9,138,118 | B2 * | 9/2015 | Kim | A47L 9/16 |
| 2014/0007369 | A1 * | 1/2014 | Williams | A47L 7/0023 15/319 |
| 2016/0353954 | A1 * | 12/2016 | Kleine-Doepke | A47L 9/1658 |

FOREIGN PATENT DOCUMENTS

| | | | |
|---|---|---|---|
| KR | 20020000415 | | 1/2002 |
| WO | 2001041619 | A1 | 6/2001 |

OTHER PUBLICATIONS

United Kingdom Patent Office Examination Report for Application No. 1405386.2 dated Apr. 19, 2016 (4 pages).

* cited by examiner

SEPARATOR ASSEMBLY FOR A SUCTION CLEANING APPARATUS

CROSS-REFERENCE TO RELATED APPLICATIONS

This application is a U.S. National Phase of International Patent Application No. PCT/GB2014/050952, filed Mar. 26, 2014, the entire contents of which are hereby incorporated by referenced herein.

BACKGROUND

This invention relates to a separator assembly for a suction cleaning apparatus. In particular, the invention relates to cyclonic separation apparatus for use in a cylinder type suction cleaner.

A typical cylinder suction cleaner includes a main body which houses a motor for providing suction to a suction inlet of the body, wheels (or equivalent) for supporting and moving the cleaner, and an electrical power source or connector for connecting to a power source. Such cleaners also include a separator assembly, which is commonly detachable from the cleaner body, and which provides an air flow path between the suction inlet of the main body and a dirty air inlet for connection to a cleaning attachment. The cleaning attachment may be a hose connected to a wand or other cleaning head, as is known in the art.

The suction provided at the suction inlet of the body causes dirt-laden air to be drawn into the dirty-air inlet of the separator assembly, the air containing dust, debris, and the like. The separator assembly comprises a separation chamber assembly for separating dirt from the dirt-laden air arriving at the dirty-air inlet, and a dirt collection chamber for receiving and storing the dirt separated from the air. Fine particulate dirt may remain in the air leaving the separation chamber. A substantial portion of the fine dirt leaving the separation chamber is subsequently removed from the air stream by a pre-motor filter that is located either on or within the separation unit, or alternatively may be located within or on the main body of the cleaner. In this way, dirt that passes through the separation unit is filtered from the air flowing to the suction motor, before reaching the motor.

In a known cyclonic separator arrangement, dirt-laden air flows into a separating chamber, in which it swirls around the chamber. Large dirt particles may be 'thrown off' to the outside of the cyclone chamber, where they fall downwards to the bottom of the chamber which forms a dirt cup, and settle in that lower portion of the chamber. The air is drawn upwardly through a central shroud defining a plurality of small apertures. The shroud acts as a filter to prevent large particles of dirt and dust passing through, allowing air to flow through (containing only small dirt particles, at most). The air is subsequently drawn further upwards and/or outwards through an outlet provided at the top of the cylinder unit (possibly passing through a pre-motor filter, if one is provided), to meet the suction inlet of the main cleaner body, providing suction from the motor. The suction inlet of the main body is therefore provided at a corresponding location on the body, to connect to the upper part of the cylinder unit when it is connected to the body.

SUMMARY

It has been found to be advantageous that the air leaving a separating chamber of a cyclonic unit passes downwards through a shroud, rather than upwards. In particular, in certain configurations where dirty air enters the chamber with an upwardly inclined trajectory, substantial benefits may be achieved. In such cases, the air leaving the chamber is drawn downwardly to an outlet provided at a lower portion of the cylinder unit, and as a result, the suction inlet of the main body must be provided at a corresponding lower location, to connect to the outlet of the cylinder unit.

An object of the present invention seeks to provide an improved separator, and a separator assembly that enables the separator to be used in connection with existing cleaner bodies.

According to an aspect of the invention we provide a cyclonic separator assembly for removing dust or debris from dirt-laden air, for use in a suction cleaning apparatus of the type having a motor mounted in a cleaner body downstream of a suction inlet, the separator assembly having a first end and a second end, and the separator assembly including:

an inlet for receiving a flow of dirty air, a separation chamber adapted to receive dirty air from the inlet and, having:

an air flow outlet formed within the separation chamber, configured such that air is drawn through the outlet in a direction generally towards the first end of the separator assembly, a shroud disposed adjacent the air flow outlet, defining a plurality of apertures, configured to prevent large dirt particles passing through the air flow outlet, and a dirt outlet defining an opening in a wall of the separation chamber;

a dirt collection chamber in communication with the dirt outlet, adapted to receive dirt separated from the dirty air; and a passage defining an air flow path from the air flow outlet towards a separator outlet in a direction generally towards the second end of the separator assembly;

such that, in use, the separator outlet is adapted to communicate with the suction inlet of the cleaner body so as to draw dirty air into the separator assembly.

Further features of the above aspects of the invention are described in the appended claims.

DETAILED DESCRIPTION

Figure 1:
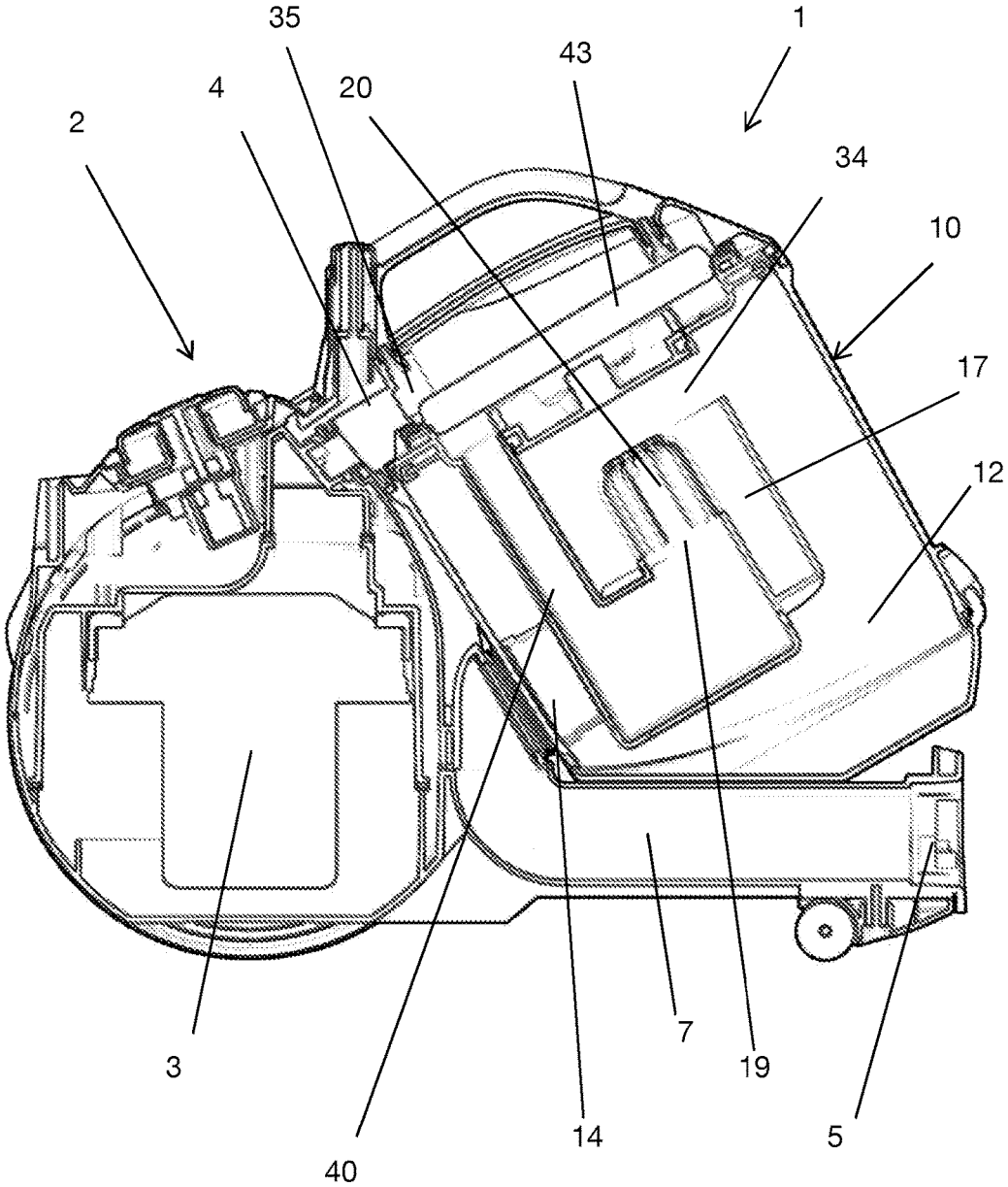
FIG. 1 is a cross-sectional side view of a suction cleaning apparatus of embodiments of the invention.
Figure 2:
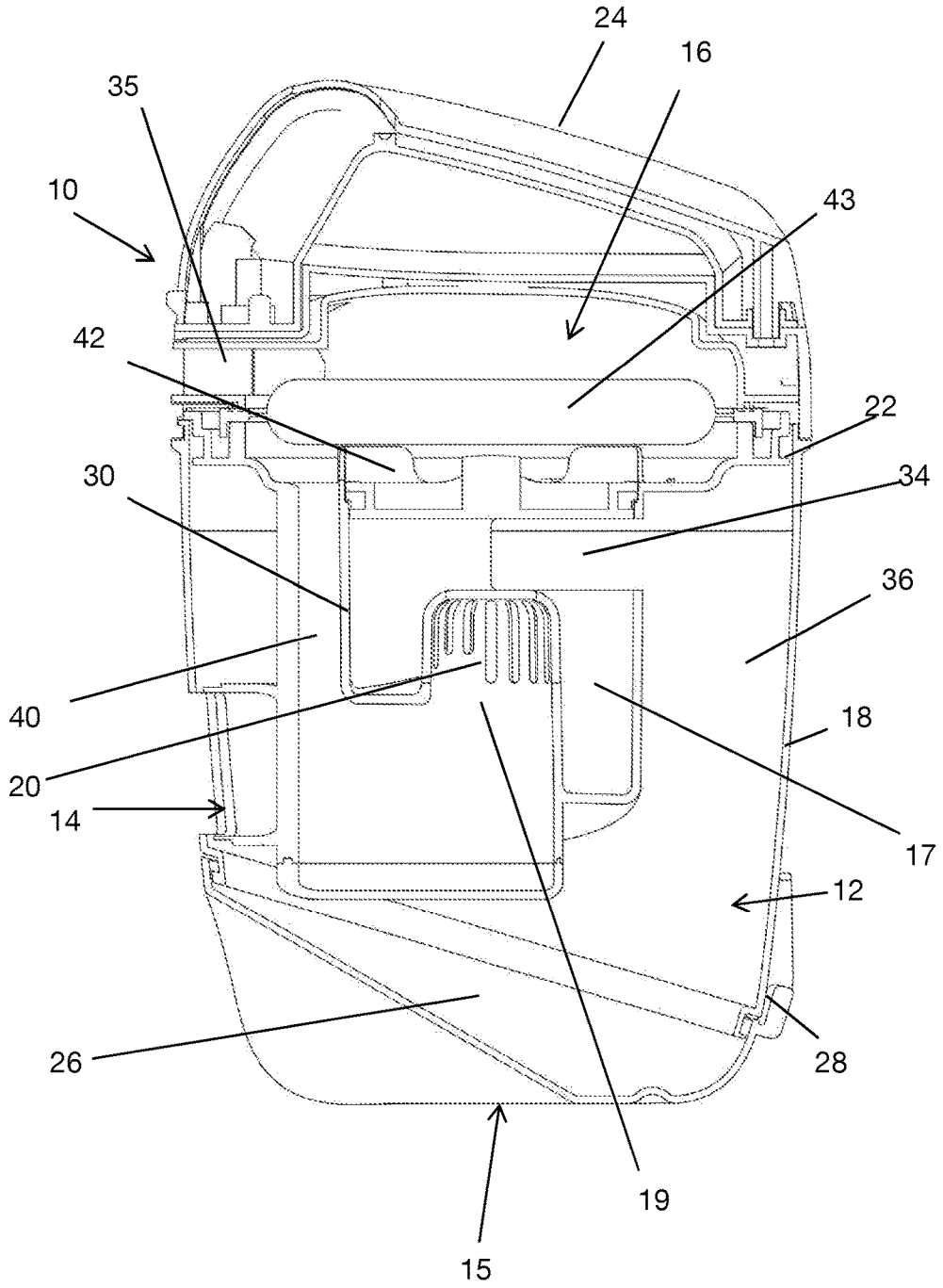
FIG. 2 is a cross-sectional side view of a separator assembly of a cleaner according to embodiments of the invention.

With reference to FIG. 1, a suction cleaner 1 is shown. The suction cleaning apparatus 1 has a cleaner body 2 and a separator assembly 10. A motor 3 is mounted on the cleaner body 2, downstream of a suction inlet 4, so as to provide a suction air flow from that inlet 4 to the motor 3.

The cleaner 1 also provides an intake passage 7, having an inlet 5 for connection to a cleaning attachment (not shown). The cleaning attachment may be a hose connected to a wand or other cleaning head, as is known in the art. The intake passage 7 is adapted for connection to a dirty air inlet 14 of the separator assembly 10, so that dirty air enters the intake passage 7 via the inlet 5, and subsequently flows to the separator assembly 10.

The suction provided at the suction inlet 4 of the cleaner body 2 causes dirt-laden air to be drawn into the inlet 5, and into the dirty-air inlet 14 of the separator assembly 10, the air containing dust, debris, and the like. The separator assembly 10 comprises a dirty air inlet 14, a separation chamber 17 for separating dirt from the dirt-laden air arriving at the dirty-air inlet 14, and a dirt collection chamber 12 for receiving and storing the dirt separated from the air. Fine particulate dirt may remain in the air leaving the separation chamber 17. A substantial portion of the fine dirt leaving the separation chamber is subsequently removed from the air stream by a pre-motor filter 43 that is located either on or within the separator assembly 10 (as shown), or alternatively may be located within or on the main body 2 of the cleaner 1. In this way, dirt that passes through the separator assembly is filtered from the air flowing to the suction motor 3, before reaching the motor 3.

The separator assembly 10 is a cyclonic separator assembly for removing dust or debris from dirt-laden air. Suction cleaners of this type, commonly known as cylinder cleaners, typically have a removable separator assembly 10, to enable dust and debris to be emptied from the assembly periodically, and for the assembly to be cleaned. While the separator assembly 10 is described in relation to a cylinder cleaner, it should be understood that the invention, and aspects of the invention, may be suitable for use with other types of suction cleaner.

With reference to FIGS. 1 to 6 of the drawings, the separator assembly 10 has a first end 15 and a second end 16, which in use, as shown, are a lowermost end 15 and an uppermost end 16, respectively. As illustrated in FIG. 1, the separator assembly 10 is supported by the cleaner body 2 in a position in which it is inclined from vertical. It should be understood that the separator assembly 10 could be supported at any one of a variety of angles, and may alternatively be held upright.

In general terms, the separator assembly 10 includes a dirty air inlet 14, a separation chamber 17, a dirt collection chamber 12, and a passage 40 communicating between an air flow outlet 19 of the separating chamber 17 and a separator outlet 35 leaving the separator assembly 10. The dirty air inlet 14 is configured such that when the separator assembly 10 is positioned on the cleaner body 2, a seal is formed between the dirty air inlet 14 and the intake passage 7. The separator assembly 10 may be held in position by way of a latching or clip mechanism, or the like.

The dirty air inlet 14 leads to the separation chamber 17. In embodiments, the dirty air inlet 14 is formed adjacent a portion of the separation chamber 17 disposed towards the first end of the separator assembly 10. In such an embodiment, the dirty air inlet 14 leads to the chamber 17 via an upwardly extending curved ramp, such that air enters the chamber 17 in a generally upwards helical flow path, forming a cyclone around an air flow outlet 19 formed within the chamber 17. In other embodiments the dirty air inlet 14 may be configured such that air enters the chamber 17 in generally downwardly curved helical path.

In general terms, the separation chamber 17 includes an air flow outlet 19, a shroud 20, and a dirt outlet 34. The air flow outlet 19 is formed within the separation chamber 17, and configured such that air is drawn through the outlet 19 in a direction generally towards the first end 15 of the separator assembly 10. In the embodiments shown in the Figures, the air is drawn downwardly through the air flow outlet 19 towards the lowermost end of the separator assembly 16. In other embodiments, the air is drawn upwardly through the air flow outlet 19 towards the uppermost end 16 of the separator assembly 16.

The shroud 20 is disposed adjacent the air flow outlet 19, defining a plurality of apertures, and configured to prevent large dirt particles passing through the air flow outlet 19. In embodiments, and as shown, the shroud provides a plurality of slots through which air is free to pass, but which are sufficiently narrow to prevent clumps of dust, dirt, debris and the like, from passing through. In embodiments, the shroud 20 may define a plurality of round apertures, or any combination of slots or apertures of a size appropriate to filter coarse dirt from the air.

The dirt outlet 34 defines an opening in a wall 30 of the separation chamber. The dirt outlet 34 provides a 'throw-off' window, through which dirt particles are thrown as the dirty air swirls within the separation chamber 17. In embodiments, the dirt outlet 34 is defined through a portion of the separation chamber wall 30 that extends approximately 180 degrees around the perimeter of the separation chamber 17. In other embodiments the dirt outlet 34 is defined through a portion of the separation chamber wall 30 that extends up to 360 degrees around the perimeter of the separation chamber 17.

Figure 7:
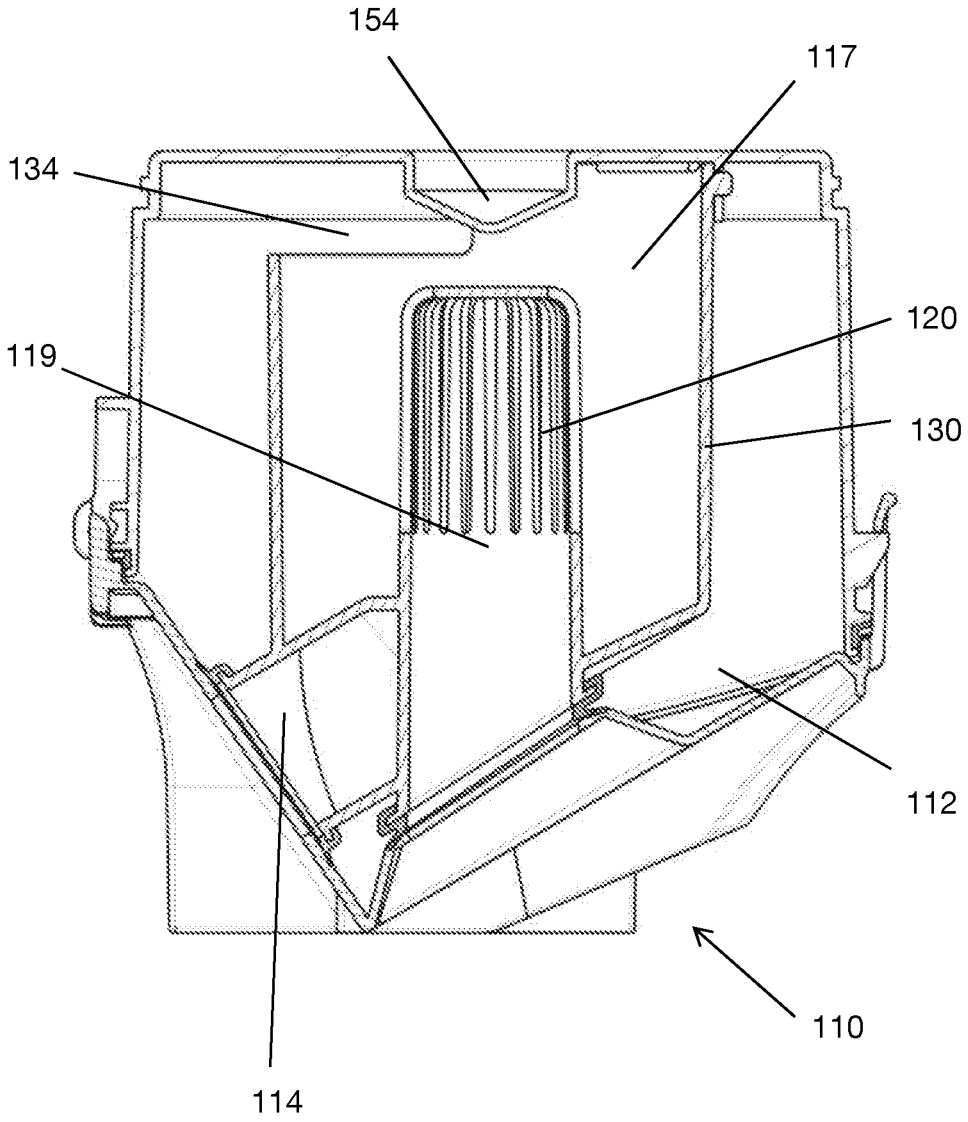
FIG. 7 is a cross-sectional side view of a separator assembly according to another embodiment of the invention.

FIG. 7 shows a portion of an alternative embodiment of the separator assembly 110. The separator assembly 110 has a dirty air inlet 114, leading to a separation chamber 117. A dirt outlet 134 is defined in a wall 130 of the chamber 117, so that dirt is thrown off through the dirt outlet 134 into the dirt collection chamber 112. Air passes through a shroud 120 so as to exit the chamber 117 via an air flow outlet 119, all in the same manner as previously described. A baffle member 154 is provided within the separation chamber 117, substantially aligned with, and spaced from, the air flow outlet 119. The baffle member 154 may be substantially conical, or substantially frustoconical. In the embodiment shown in FIG. 7, the baffle member 154 extends downwardly from an upper portion of the chamber, so that a tip of the baffle member lies over, and slightly spaced from, the shroud 120 across the air flow outlet 119. The baffle member 154 improves cyclonic air flow within the separation chamber 117, and thereby improves the dirt separating ability of the separator. In embodiments, the baffle member 154 is domed, or substantially cylindrical. Of course, all other aspects of the embodiments shown in FIG. 7 remain the same as in other embodiments, and a baffle member 154 may be included in combination with any other combination of features described herein.

Figure 4:
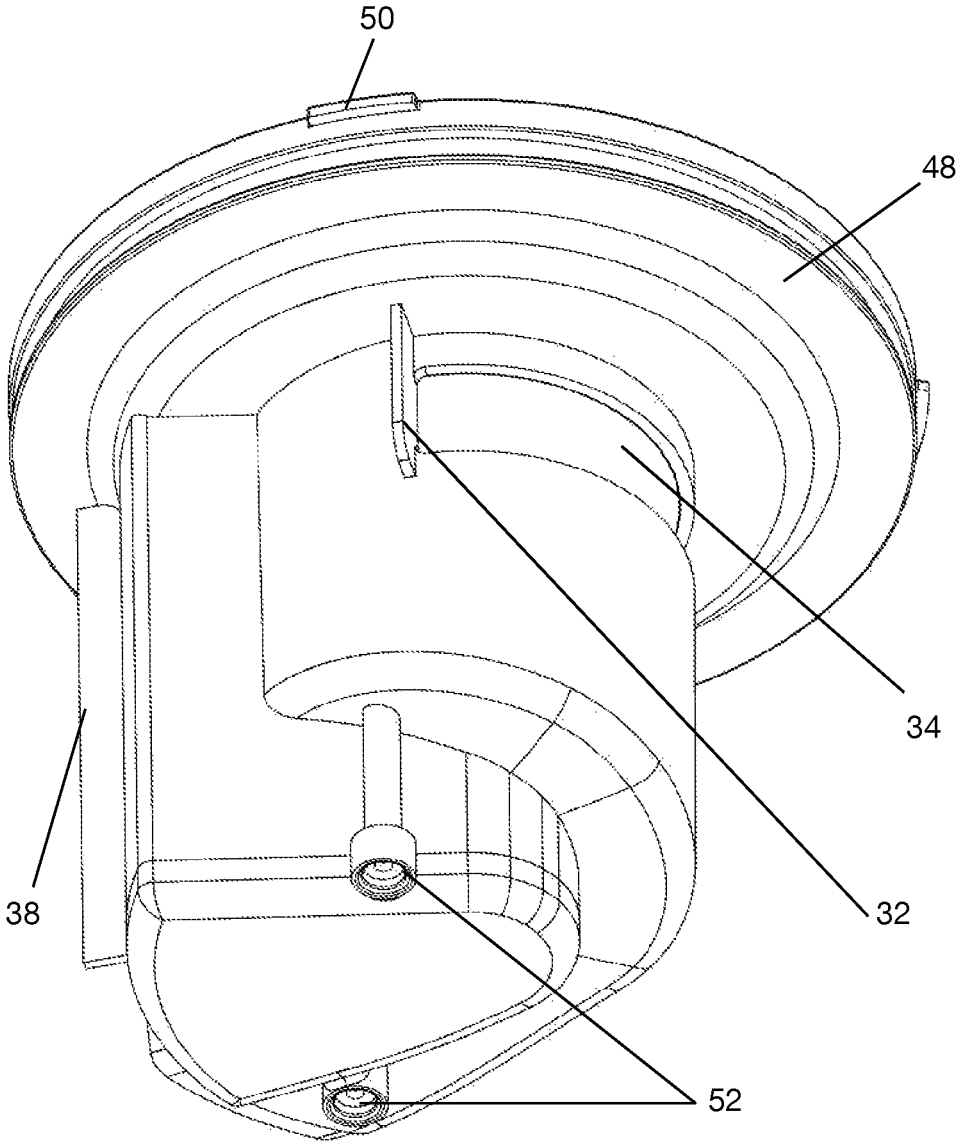
FIG. 4 is an alternative perspective view of the portion of the separator assembly of FIG. 3.
Figure 5:
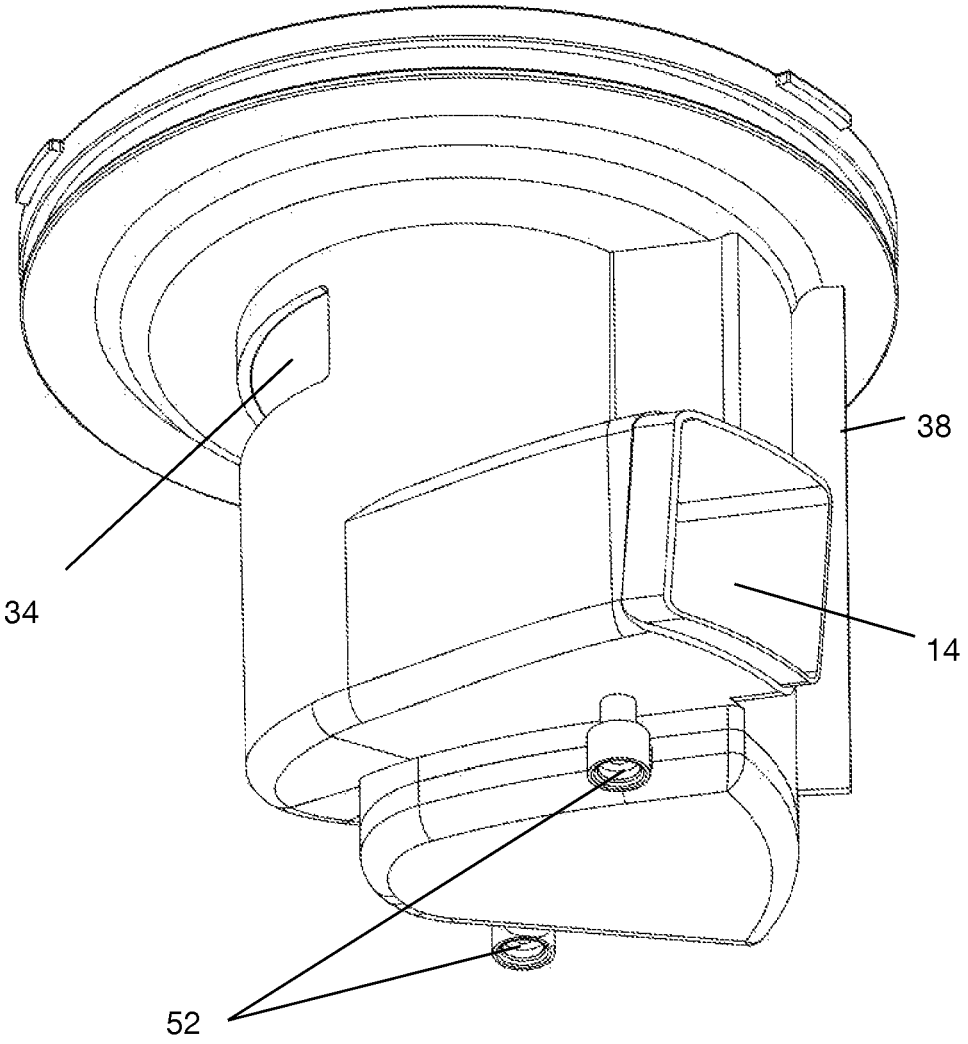
FIG. 5 is an alternative perspective view of the portion of the separator assembly of FIG. 3.
Figure 6:
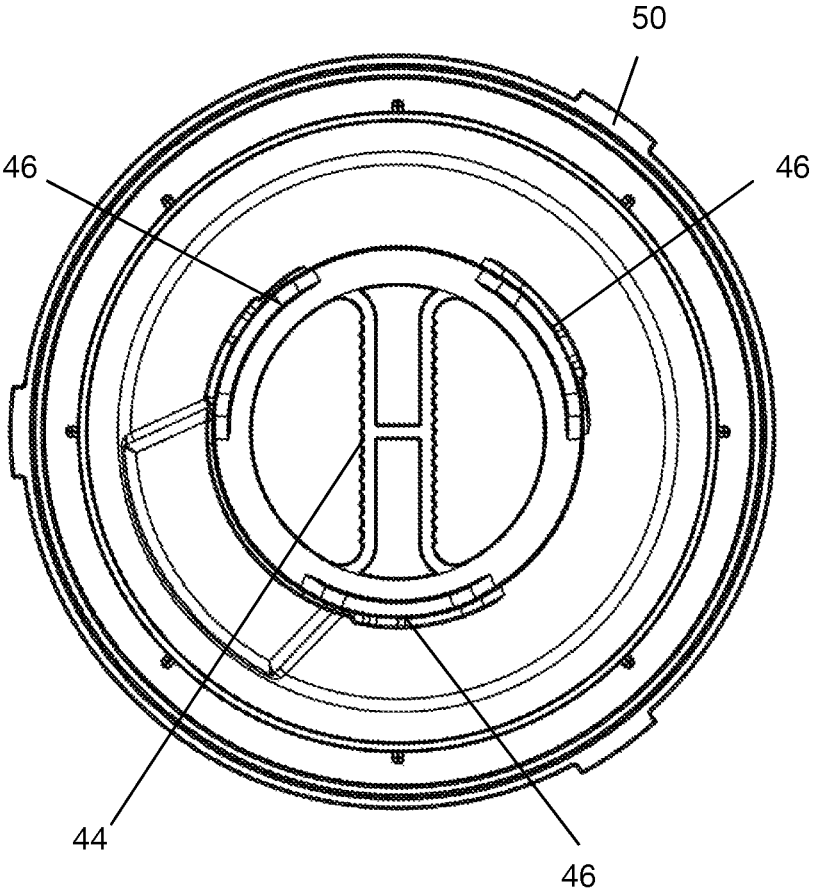
FIG. 6 is a plan view of a separator assembly according to embodiments of the invention.

In embodiments, and as shown in FIG. 4, a deflecting ridge 32 may extend outwards from the chamber wall 30 adjacent an end of the dirt outlet 34. The deflecting ridge 32 provides a surface against which dirt entrained in the air swirling within the separation chamber 17 may collide. Hairs, threads, scraps of material, and the like, are commonly snagged on the relatively thin edge of the separation chamber wall 30 that forms an end of the dirt outlet 34. By providing a surface of relatively large width, compared to the thickness of the chamber wall 30, such hairs and the like are less likely to become snagged and held at the end of the dirt outlet 34. Such snagging causes clogging or blocking of the dirt outlet 34, resulting in reduced performance of the separator.

The dirt collection chamber 12 is provided in communication with the dirt outlet 34, and is adapted to receive dirt separated from the air. In embodiments, the dirt collection chamber 12 is defined between the separation chamber wall 30 and an outer housing 18. The dirt thrown off from the cyclone, through the dirt outlet 34, moves outwardly into the volume 36 defined between the separation chamber wall 30 and an outer housing 18, and falls downwards towards the first end 15 of the separator assembly 10, where it collects and settles in the lowermost portion of the dirt collection chamber 12.

Figure 3:
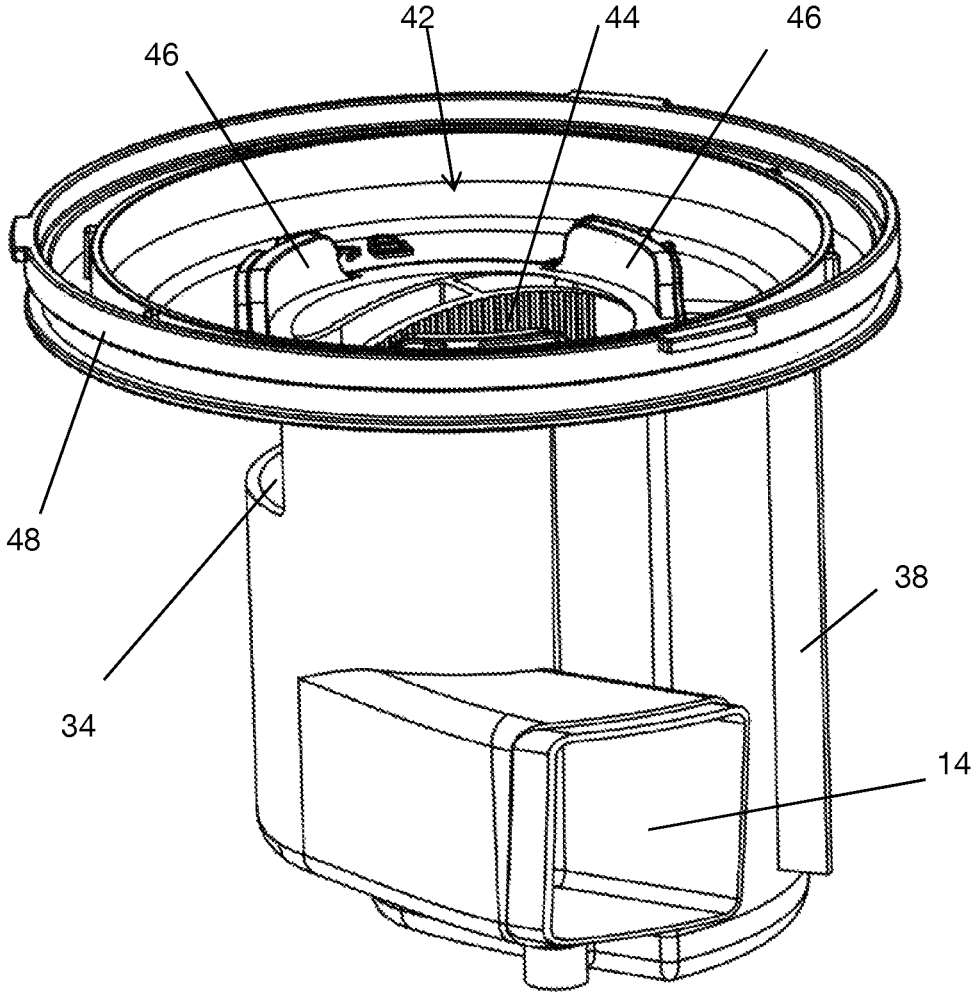
FIG. 3 is a perspective view of a portion of a separator assembly according to embodiments of the invention.

In embodiments, a rib 38 is provided within the dirt collection chamber 12. The rib extends across a portion of the dirt collection chamber 12 between the outer housing 18 and the separation chamber 17. In embodiments, and as shown in FIG. 3, the rib 38 may extend outwardly from the separation chamber 17 towards the outer housing 30.

In embodiments, the lowermost edge of the opening defining the dirt outlet 34 is substantially level with the uppermost portion of the shroud 20.

The separator assembly further includes a passage 40 defining an air flow path from the air flow outlet 19 towards the separator outlet 35. In use, the separator outlet 35 is adapted to communicate with the suction inlet 4 of the cleaner body 2 so as to draw dirty air into the separator assembly 10.

As stated above, air is drawn through the outlet 19 in a direction generally towards the first end 15 of the separator assembly 10. The passage 40 leads from the air flow outlet in a direction generally towards the second end 16 of the separator assembly 10, towards the separator outlet 35 which is positioned at or adjacent the second end 16. In embodiments, where the separator outlet is disposed towards the uppermost end of the separator assembly 10, as shown, the passage 40 leads upwardly from the air flow outlet 19 towards the separator outlet 35 adjacent the uppermost end 16. In other embodiments, the relative uppermost and lowermost positions may be reversed. In embodiments, the passage 40 defining the air flow path from the air flow outlet 19 is formed integrally with the wall 30 of the separation chamber.

In embodiments, a pre-motor filter 43 is provided adjacent the separator outlet 35, configured so that air passes through the filter 43 before reaching the separator outlet 35.

In embodiments, with reference to FIGS. 3 to 6, in particular, a filter-holding arrangement 42 may be provided towards the second end 16 of the separating assembly 10. The filter-holding arrangement 42 may be formed integrally with the separation chamber 17, or may be provided separately. The filter-holding arrangement 42 includes an outer rim 48 adapted to fit to the outer housing 18 of the separator assembly 10. A securing arrangement 22 may be provided on one or both parts, so as to hold the filter-holding arrangement (and integrated separation chamber, if those parts are formed as such) securely to the outer housing 18. In embodiments, the securing arrangement 22 may include outwardly extending tabs 50, adapted to engage with corresponding recesses defined in the outer housing 18, or to sit on the uppermost rim of the housing 18, to support the filter-holding arrangement 42 in position.

The filter-holding arrangement 42 further defines an opening therethrough, so as to allow air to flow through the arrangement 42, from the passage 40 to the separator outlet 35. One or more aligning walls 46 (in this example three) extend upwards from a base plate of the filter-holding arrangement 42, adapted to abut against a portion of a filter (not shown), to secure it substantially against lateral movement. A user-graspable portion 44 may extend upwards from the base plate of the arrangement 42, to enable a user to grasp the arrangement 42 so as to remove it from the outer housing 18, for cleaning purposes, and/or to allow access to the dirt collection chamber 12 below.

As described above, in other embodiments, no pre-motor filter is provided on the separator assembly 10—rather, a pre-motor filter is provided on or within the cleaner body 2.

In embodiments a handle 24 is provided at the uppermost end 16 of the separator assembly 10, to enable a user to grip the separator assembly 10 in order to lift it from the cleaner body 2.

A base portion 26 of the separator assembly 10 is connected to the lowermost end 15 of the separator assembly by a connection arrangement 28. The connection arrangement may include a latch, a clip, or a threaded portion, for engagement with a corresponding formation on the outer housing 18 of the separator assembly 10. The base portion 26 may be removable from the outer housing 18, to enable access to the dirt collection chamber 12 so as to empty dirt and debris from the chamber 12.

In embodiments, a lowermost portion of the separation chamber 17 and/or the dirty air inlet 14 provides downwardly-extending feet 52 adapted to abut a portion of the base portion 26. The feet 52 provide support for the separation chamber 17 and/or dirty air inlet so as to hold those respective parts in position within the outer housing 18.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cyclonic separator assembly for removing dust or debris from dirt-laden air, for use in a suction cleaning apparatus of the type having a motor mounted in a cleaner body downstream of a suction inlet, the separator assembly comprising:

a lowermost end, an uppermost end, an inlet for receiving a flow of dirty air, a separation chamber adapted to receive the flow of dirty air from the inlet and, having:

an air flow outlet formed within the separation chamber, configured such that air is drawn through the air flow outlet in a direction generally towards the lowermost end of the separator assembly, a shroud disposed adjacent the air flow outlet, defining a plurality of apertures, configured to prevent large dirt particles passing through the air flow outlet, and a dirt outlet defining an opening in a wall of the separation chamber;

a dirt collection chamber in communication with the dirt outlet, adapted to receive dirt separated from the flow of dirty air; and a passage defining an air flow path from the air flow outlet towards a separator outlet in a direction generally towards the uppermost end of the separator assembly;

such that, in use, the separator outlet is adapted to communicate with the suction inlet of the cleaner body so as to draw dirty air into the separator assembly.

2. A cyclonic separator assembly according to claim 1, wherein the dirty air inlet is formed adjacent a portion of the separation chamber disposed towards the lowermost end of the separator assembly.

3. A cyclonic separator assembly according to claim 1 further including a ramp configured to direct dirty air entering the chamber through the dirty air inlet in a generally helical path within the chamber.

4. A cyclonic separator assembly according to claim 1, wherein the separation chamber provides a baffle member substantially aligned with, and spaced from, the air flow outlet.

5. A cyclonic separator assembly according to claim 4 wherein the baffle member is one of: substantially conical, substantially frustoconical, domed, or substantially cylindrical.

6. A cyclonic separator assembly according to claim 1 wherein the dirt collection chamber is defined between the separation chamber wall and an outer housing.

7. A cyclonic separator assembly according to claim 1 wherein the lowermost edge of the opening defining the dirt outlet is substantially level with the uppermost portion of the shroud.

8. A cyclonic separator assembly according to claim 1 wherein the dirt outlet is defined through a portion of the separation chamber wall that extends approximately 180 degrees around the perimeter of the separation chamber.

9. A cyclonic separator assembly according to claim 1 further including a deflecting ridge that extends outwards from the chamber wall adjacent an end of the dirt outlet.

10. A cyclonic separator assembly according to claim 1 further including a rib that extends across a portion of the dirt collection chamber between the outer housing and the separation chamber.

11. A cyclonic separator assembly according to claim 10 wherein the rib extends outwards from the separation chamber towards the outer housing.

12. A cyclonic separator assembly according to claim 1 wherein a pre-motor filter is provided adjacent the separator outlet, configured so that air passes through the filter before reaching the separator outlet.

13. A cyclonic separator assembly according to claim 1, in which the passage defining the air flow path from the air flow outlet is formed integrally with the wall of the separation chamber.

14. A suction cleaning apparatus comprising a motor mounted in a cleaner body downstream of a suction inlet, including a separator assembly according to claim 1.

* * * * *